US009912050B2

(12) United States Patent
Manry, Jr.

(10) Patent No.: US 9,912,050 B2
(45) Date of Patent: Mar. 6, 2018

(54) RING ANTENNA ARRAY ELEMENT WITH MODE SUPPRESSION STRUCTURE

(71) Applicant: THE BOEING COMPANY, Huntington Beach, CA (US)

(72) Inventor: Charles W. Manry, Jr., Auburn, WA (US)

(73) Assignee: THE BOEING COMPANY, Chicago, IL (US)

( * ) Notice: Subject to any disclaimer, the term of this patent is extended or adjusted under 35 U.S.C. 154(b) by 89 days.

(21) Appl. No.: 14/826,900

(22) Filed: Aug. 14, 2015

(65) Prior Publication Data

US 2017/0047660 A1 Feb. 16, 2017

(51) Int. Cl.

| | |
|---|---|
| ***H01Q 13/12*** | (2006.01) |
| ***H01Q 1/52*** | (2006.01) |
| ***H01Q 9/04*** | (2006.01) |
| *H01Q 3/30* | (2006.01) |
| *H01Q 21/06* | (2006.01) |

(52) U.S. Cl.

CPC ..... *H01Q 1/523* (2013.01); *H01Q 9/0421* (2013.01); *H01Q 9/0435* (2013.01); *H01Q 9/0442* (2013.01); *H01Q 9/0457* (2013.01); *H01Q 3/30* (2013.01); *H01Q 21/065* (2013.01)

(58) Field of Classification Search

CPC ..... H01Q 5/50; H01Q 5/1521; H01Q 3/30

USPC ..... 343/769

See application file for complete search history.

(56) References Cited

U.S. PATENT DOCUMENTS

| | | | | |
|---|---|---|---|---|
| 3,754,271 | A | 8/1973 | Epis | |
| 5,194,876 | A | 3/1993 | Schnetzer et al. | |
| 5,539,420 | A | 7/1996 | Dusseux et al. | |
| 5,940,037 | A | 8/1999 | Kellerman et al. | |
| 5,995,058 | A | 11/1999 | Legay et al. | |
| 6,173,191 | B1 * | 1/2001 | Jennings, III | H01Q 1/246 455/277.1 |
| 6,624,787 | B2 | 9/2003 | Puzella et al. | |
| 6,670,930 | B2 | 12/2003 | Navarro | |
| 7,053,847 | B2 | 5/2006 | Chan et al. | |
| 7,215,288 | B2 | 5/2007 | Park et al. | |
| 7,283,101 | B2 * | 10/2007 | Bisiules | H01Q 1/246 343/700 MS |
| 7,427,957 | B2 | 9/2008 | Zeinolabedin Rafi et al. | |
| 8,279,131 | B2 | 10/2012 | Puzella et al. | |

(Continued)

FOREIGN PATENT DOCUMENTS

EP 2551959 B1 4/2014

OTHER PUBLICATIONS

U.S. Appl. No. 13/476,953, filed May 21, 2012.

(Continued)

*Primary Examiner* — Huedung Mancuso

(74) *Attorney, Agent, or Firm* — Armstrong Teasdale LLP

(57) ABSTRACT

A radio frequency (RF) circuit for a ring antenna array element includes first and second feed elements, and a conductive element disposed between the first and second feed elements. The first and second feed elements are electrically couplable to a conductive resonator for a frequency band. The first feed element is configured to conduct an electromagnetic current. The conductive element is configured to resonate outside the frequency band to reduce cross-coupling between the first feed element and the second feed element due to the electromagnetic current.

20 Claims, 7 Drawing Sheets

(56) References Cited

U.S. PATENT DOCUMENTS

| | | | | |
|---|---|---|---|---|
| 8,749,446 | B2 | 6/2014 | Manry, Jr. et al. | |
| 8,773,323 | B1 | 7/2014 | Manry, Jr. et al. | |
| 8,912,970 | B1 | 12/2014 | Manry, Jr. et al. | |
| 9,461,368 | B2 * | 10/2016 | Azulay | H01Q 1/007 |
| 2003/0210193 | A1 | 11/2003 | Rossman et al. | |
| 2004/0183735 | A1 | 9/2004 | Jecko et al. | |
| 2004/0217907 | A1 | 11/2004 | Inoue | |
| 2005/0237259 | A1 | 10/2005 | Stephens | |
| 2007/0052587 | A1 | 3/2007 | Cheng | |
| 2008/0309428 | A1 | 12/2008 | Son et al. | |
| 2009/0073072 | A1 * | 3/2009 | Lindenmeier | H01Q 1/3275 343/810 |
| 2010/0253587 | A1 * | 10/2010 | Lindenmeier | H01Q 7/00 343/797 |
| 2012/0026066 | A1 | 2/2012 | Leisten | |
| 2012/0268347 | A1 | 10/2012 | Tatamikov et al. | |

OTHER PUBLICATIONS

Chen, J., Dual-Frequency Annular-Ring Slot Antennas Fed by CPW Feed and Microstrip Line Feed, IEEE Transactions on Antennas and Propagation, Jan. 2005, pp. 569-571, vol. 53, No. 1.

Ren, Y. et al., An Ultrawideband Microstrip Dual-Ring Antenna for Millimeter-Wave Applications; IEEE Antennas and Wireless Propagation Letters, 2007, pp. 457-459, vol. 6.

Das, A. et al., Radiation Characteristics of Higher-Order Modes in Microstrip Antenna, IEEE Proceedings, Apr. 1984, pp. 102-103, vol. 131, Pt. H, No. 2.

Chew, W., A Broad-Band Annular-Ring Microstrip Antenna, IEEE Transactions on Antennas and Propagation, Sep. 1982, pp. 918-922, vol. AP-30, No. 5.

Bahl, I. J. et al., A New Microstrip Radiator for Medical Applications, IEEE Transaction on Microwave Theory and Techniques, Dec. 1980, pp. 1464-1468, vol. MTT-28, No. 12.

Olaode, O. et al., Effects of Meandering on Dipole Antenna Resonant Frequency, IEEE Antennas and Wireless Propagation Letters, 2012, pp. 122-125, vol. 11.

Cristal, E G., Meander-Line and Hybrid Meander-Line Transformers, Microwave Symposium IEEE GMTT International, May 1972, pp. 149-151.

Hockham, G. A. et al., Broadband Meander-Line Planar Array Antenna, Antennas and Propagation Society International Symposium, 1979, pp. 645-648.

Raiva, A. et al., Frequency Selective Surfaces: Design of Broadband Elements and New Frequency Stabilization Techniques, Proceedings of the 203 Antenna Application Symposium (27th), Sep. 17-19, 2003, vol. 1, pp. 107-130.

Wang, C.W. et al., Antenna Models for Electromagnetic Compatibility Analyses, U.S. Department of Commerce, Oct. 2012, 490 pages.

Johnson, R., Antenna Engineering Handbook, Third Edition, McGraw-Hill 1993.

Munk, B., Frequency Selective Surfaces, Theory and Design, Wiley-Interscience 2000.

* cited by examiner

RING ANTENNA ARRAY ELEMENT WITH MODE SUPPRESSION STRUCTURE

INCORPORATION BY REFERENCE

U.S. patent application Ser. No. 13/476,953 filed May 21, 2012 titled "Cog Ring Antenna for Phased Array Applications," is incorporated herein by reference in its entirety.

BACKGROUND

The field of the disclosure relates generally to ring antennas for phased arrays, and more specifically to controlling cross-coupling using a mode suppression structure.

Current microwave and millimeter-wave frequency antennas generally include cumbersome structures such as waveguides, dish antennas, helical coils, horns, and other large non-conformal structures. Communication applications, where at least one communicator is moving, and radar applications generally require a steerable beam or steerable reception. Phased array antennas are particularly useful for beam steered applications since beam steering can be accomplished electronically without physical motion of the antenna. Electronic beam steering can be faster and more accurate and reliable than gimbaled/motor-driven mechanical antenna steering.

BRIEF DESCRIPTION

According to one aspect of the present disclosure, a radio frequency circuit for a ring antenna array element is provided. The radio frequency circuit includes first and second feed elements, and a conductive element disposed between the first and second feed elements. The first and second feed elements are electrically couplable to a conductive resonator for a frequency band. The first feed element is configured to conduct an electromagnetic current. The conductive element is configured to resonate outside the frequency band to reduce cross-coupling between the first feed element and the second feed element due to the electromagnetic current.

According to another aspect of the present disclosure, an antenna array element is provided. The antenna array element includes a conductive resonator, a first feed element, a second feed element, and a mode suppression structure. The conductive resonator is operable in at least a first frequency band and includes a conductive ring. The first feed element is electrically couplable to the conductive ring and is configured to operate the conductive resonator in the first frequency band. The second feed element is electrically couplable to the conductive resonator. The mode suppression structure includes a conductive element disposed between the first feed element and the second feed element. The conductive element is configured to resonate outside the first frequency band to reduce cross-coupling between the first feed element and the second feed element.

According to yet another aspect of the present disclosure, a method of forming an antenna array on a circuit board is provided. The method includes forming a conductive ring on a first layer. The conductive ring is operable in a first frequency band and a second frequency band. The method further includes forming a first feed element on a second layer. The first feed element is capacitively coupled to the conductive ring. The method further includes forming a second feed element on the second layer. The second feed element is separated from the first feed element by an angle and is capacitively coupled to the conductive ring. The method further includes forming a first conductive element on or below the second layer. The first conductive element is disposed between the first feed element and the second feed element. The first conductive element has a length and width configured to cause the first conductive element to resonate at frequencies outside the first frequency band and the second frequency band.

The features, functions, and advantages that have been discussed can be achieved independently in various embodiments or may be combined in yet other embodiments, further details of which can be seen with reference to the following description and drawings.

DETAILED DESCRIPTION

Figure 1:
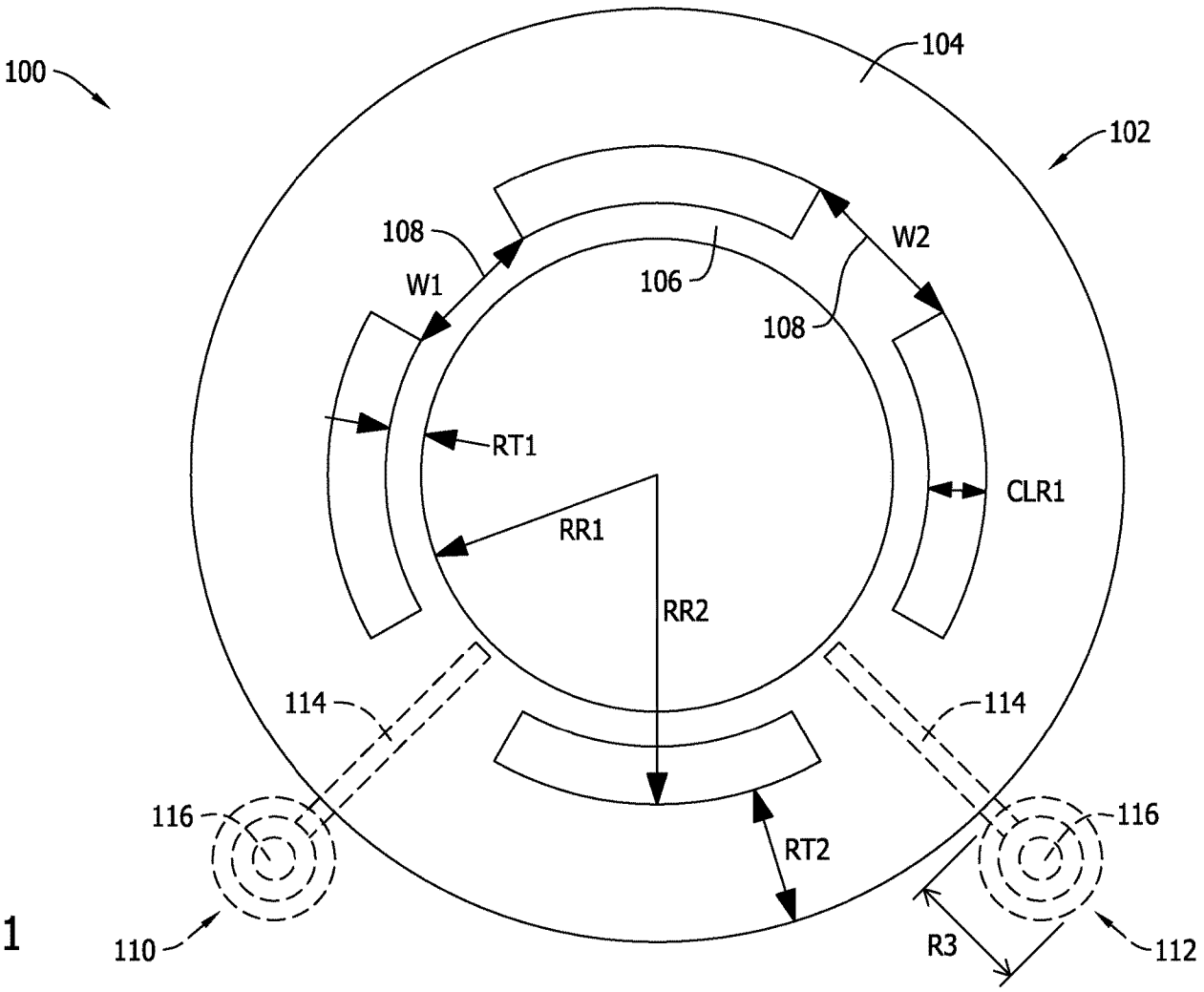
FIG. 1 is a diagram of one embodiment of a ring antenna array element.

As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

In certain applications, conformal phased array antennas require wide frequency coverage and large scan volumes. For example, certain SATCOM systems cover a commercial band of 17.7-20.2 Gigahertz (GHz) and a military band of 20.2-21.2 GHz, and also scan up to 60 degrees from boresight. In another example, certain SATCOM systems operate in the 27.5-31 GHz band and the 43.5-45.5 GHz band. These systems are referred to as dual-band.

Dual-band applications typically utilize either multiple phased array antennas or dual-band dish antennas under radomes. Single dual-band antennas reduce the cost, size, weight, and power demands relative to single-band solutions and dish antennas. Conformal phased arrays are generally light weight and thin, suiting certain applications where dish antennas, radomes, and mechanically-scanned arrays are less practical.

In certain applications, conformal phased arrays are implemented using slot rings and microstrip antenna array elements. A phased array is includes multiple antenna array elements configured in a particular arrangement, or structure. In certain embodiments, the antenna array elements are configured in a lattice structure to form the array. However, it is realized herein that such antennas suffer from mutual coupling that limit their scan volume and frequency coverage. It is further realized herein that cross-coupling is particularly challenging between two orthogonally polarized feed lines, where cross coupled energy is coupled from the RF inputs onto the ring element itself. In these applications, elements often exhibit reduced scan performance due to poor circular polarized axial ratio values when scanned near the horizon. Axial ratio is a measure of radio frequency channel separation between left and right circular polarized signals. In certain embodiments, ring elements utilize cog structures to broaden bandwidth and improve axial ratio performance of the phased array. The cog structures also provide an additional tuning variable to support the frequency band of interest.

Thus, exemplary embodiments may provide ring antenna array elements with improved mode suppression by control of cross-coupling between feed lines. More specifically, exemplary embodiments provide tuned conductive elements, or stubs, disposed between feed lines to suppress in-band cross-coupling resonance on the ring element and its underlying feed structure. The conductive stubs are tuned by appropriate design features, including: quantity, length, width, angular separation, and location relative to the feed lines and the antenna array element. Moreover, the tuned conductive stubs may vary in dimension within a given embodiment, such as, for example, a tapered microstrip. The mode suppression structures described herein facilitate dual-band phased arrays that are thin and light weight with good out-of-band mode suppression. The addition of mode suppression structures described herein can yield antenna array elements having cross-coupling between feed lines of −6 dB or lower.

FIG. 1 is a diagram of one embodiment of a ring antenna array element 100. FIG. 1 shows a top-down view of ring antenna array element 100, including a linked-ring conductive resonator 102 implemented on a top layer of ring antenna array element 100. Conductive resonator 102 includes an outer ring element 104 and an inner ring element 106. Inner ring element 106 and outer ring element 104 are linked by equally spaced tuning tabs 108. Ring antenna array element 100 includes a first feed line 110 and a second feed line 112, both capacitively coupled to conductive resonator 102.

First feed line 110 and second feed line 112 are implemented as microstrip feed structures on a second layer of ring antenna array element 100, below conductive resonator 102. In certain embodiments, first feed line 110 and second feed line 112 are disposed normal to each other, e.g., separated by substantially 90 degrees. A right angle configuration of first feed line 110 and second feed line 112 provides for bi-modal operation of ring antenna array element 100. Bi-modal operation facilitates selection of either right-hand circular polarized or left-hand circular polarized signals to be received for SATCOM applications, or dual orthogonal linearly polarized signals for other applications. First feed line 110 and second feed line 112 include microstrip feed structures 114 that are connected to signal sources by coupling vias 116 that run from the bottom of microstrip feed structures 114, through the layers beneath first feed line 110 and second feed line 112, to a ground plane (not shown). Microstrip feed structures 114 have a strip thickness ST1 (shown in FIG. 2), and a pad radius R3 at a connection point to coupling vias 116. First feed line 110 and second feed line 112 deliver energy to outer ring element 104, causing outer ring element 104 to resonate. The structure and configuration of inner ring element 106 and tuning tabs 108 facilitate tuning conductive resonator 102 to a desired frequency band.

Inner ring element 106 has an inner ring radius RR1 and outer ring element 104 has an inner ring radius RR2. Inner ring element 106 has a ring thickness RT1 and outer ring element 104 has a ring thickness RT2. Inner ring element 106 and outer ring element 104 are separated by a clearance CLR1. Tuning tabs 108 have an inner width W1 and an outer width W2. For a given frequency band, an exemplary embodiment will have a certain number of ring elements, such as inner ring element 106 and outer ring element 104, a number of tuning tabs 108, and the corresponding dimensions for each, such as RR1, RR2, RT1, RT2, W1, W2, and CLR1, to tune conductive resonator 102 to the desired frequency band. In one embodiment, ring antenna array element 100 is configured for a frequency band of 17.7-21.2 GHz. In that embodiment, inner ring element 106 has an inner ring radius RR1 of 36.6 thousandths of an inch (mils) with a ring thickness RT1 of 6.2 mils. Outer ring element 104 has an inner ring radius RR2 is 53.6 mils with a ring thickness RT2 24.8 mils. Clearance CLR1 between inner ring element 106 and outer ring element 104 is 10.8 mils. Tuning tabs 108 have an inner width W1 of 22.2 mils and an outer width W2 of 27.7 mils.

Figure 2:
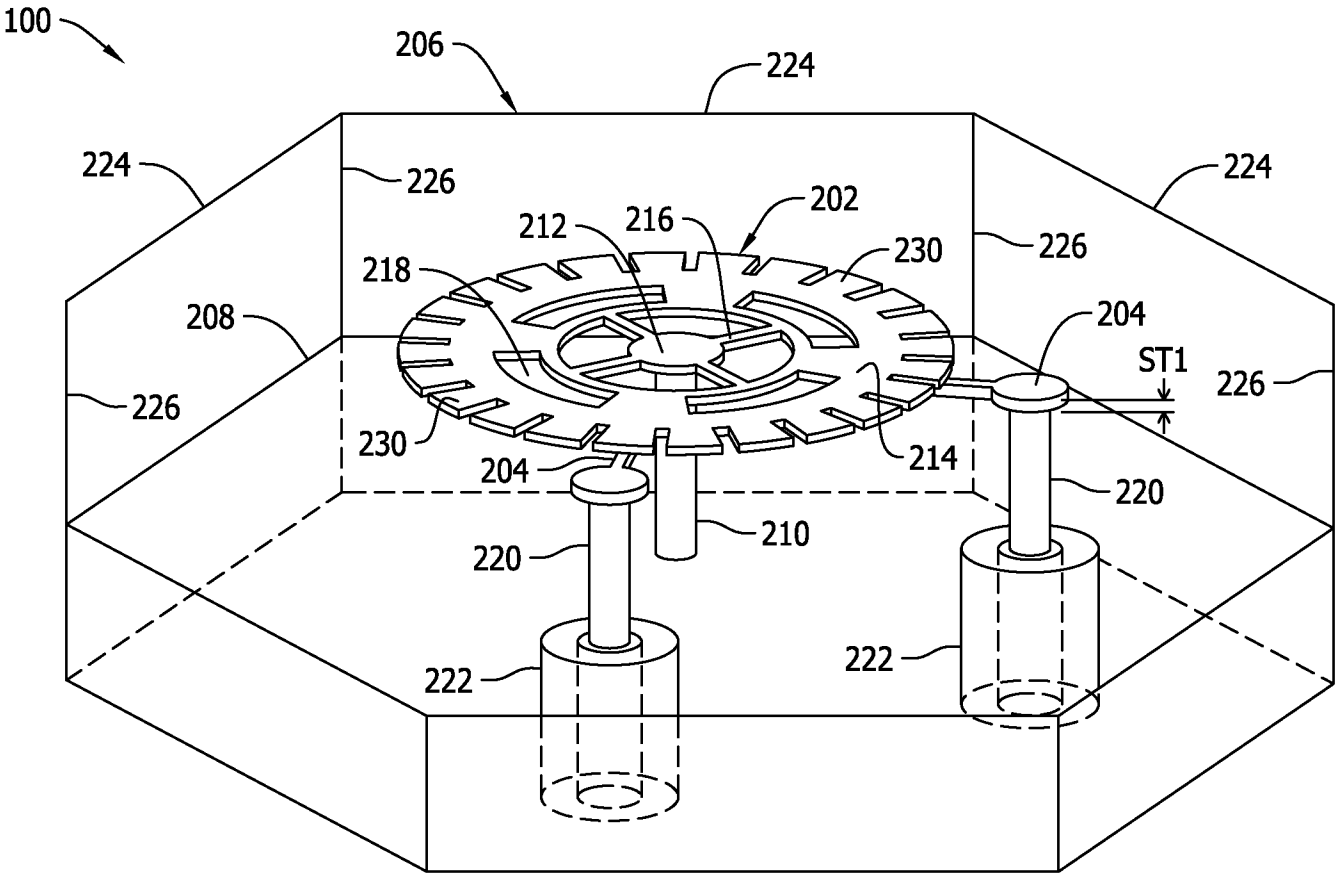
FIG. 2 is a diagram of another embodiment of a ring antenna array element.

FIG. 2 is a diagram of another embodiment of a ring antenna array element 200 for phased array applications. Ring antenna array element 200 includes a cog ring conductive resonator 202 and feed lines 204. Certain embodiments of ring antenna array element 200 include a Faraday cage 206, including an electromagnetically-shielding ground plane 208, and a shorting pin 210.

Shorting pin 210 couples from a top center of conductive resonator 202 to ground plane 208. Conductive resonator 202 includes an inner disk 212 coupled to shorting pin 210. Shorting pin 210 facilitates broader frequency coverage by ring antenna array element 200. In alternative embodiments, shorting pin 210 is omitted.

Conductive resonator 202 is operable over a band of frequencies, and includes a ring resonator 214 and spokes 216. Conductive resonator 202 further includes tuning slots 218. In various embodiments, various shapes and combinations of resonators are used to form a single-band antenna, a dual-band antenna, or a multi-band antenna.

Feed lines 204 are electromagnetically coupled to conductive resonator 202 and are configured to transmit and receive signals through conductive resonator 202. Feed lines 204 include vias 220 coupled to signal lines 222. Alternative embodiments include any suitable number and configuration of feed lines for the desired frequency band of operation. Feed lines 204 may be implemented by, for example, and without limitation, metallization or microstrip feed structures. Feed lines 204 are spaced, for example, substantially 90 degrees apart to facilitate selection of receiving either right-hand circular polarized or left-hand circular polarized signals for SATCOM applications, or other suitable spacing for other applications.

Faraday cage 206 is configured to shield conductive resonator 202 and feed lines 204. Faraday cage 206 includes, for example, and without limitation, ground plane 208, conductive strips 224, and conductive vias 226 coupled to ground plane 208.

Conductive resonator 202 includes cog structures 230 along an outer edge of ring resonator 214. Cog structures 230 control current flow around the outer edge, providing good circular polarization, good axial ratio over specified frequency bands, and improved component matching. The quantity, shape, area, and spacing of cog structures 230 facilitate tuning conductive resonator to a particular frequency band. In alternative embodiments, conductive resonator 202 includes cog structures along an inner edge of ring resonator 214.

Figure 3:
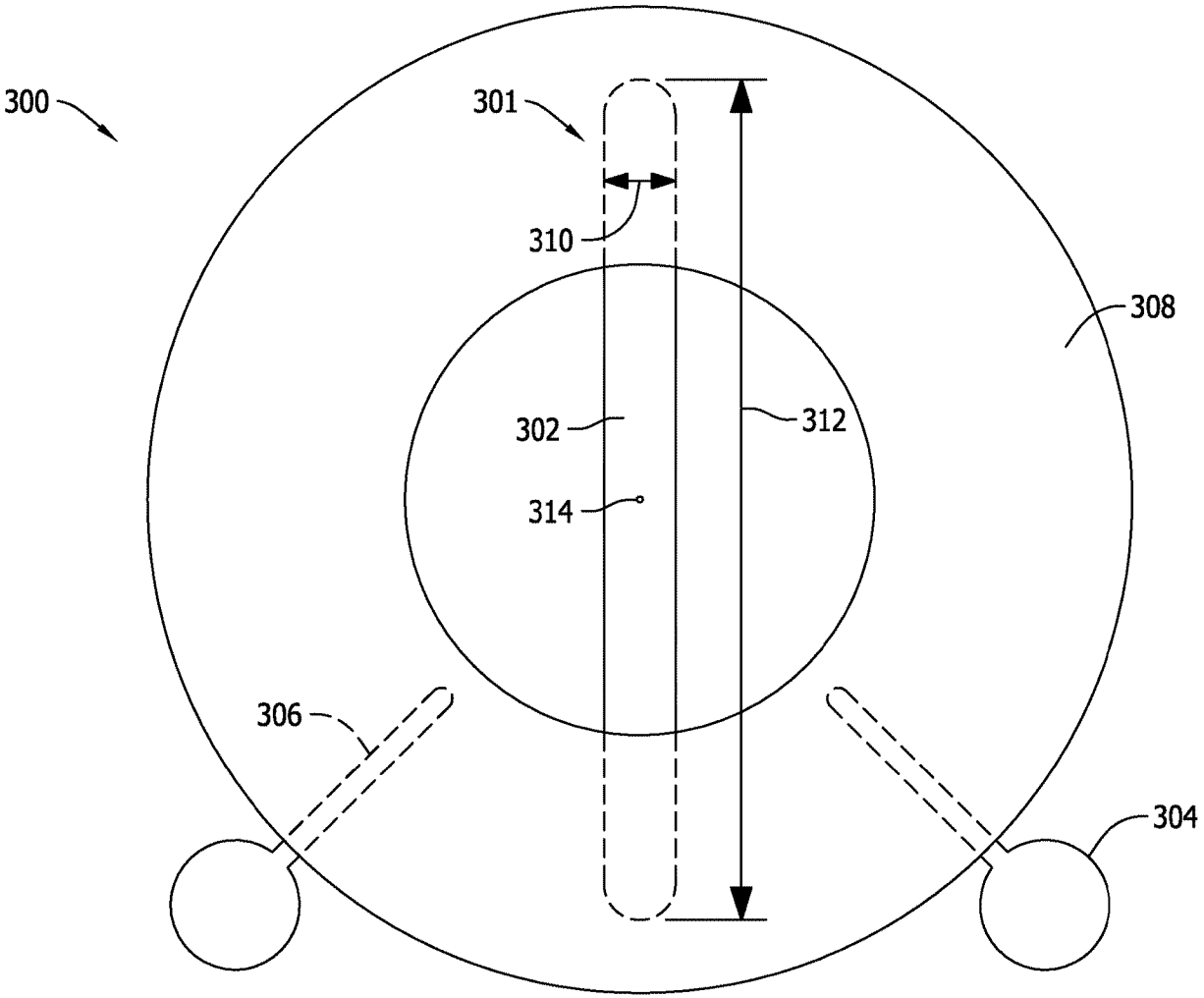
FIG. 3 is a diagrammatic representation of a top plan view of one embodiment of a ring antenna array element with a mode suppression structure.

FIG. 3 is a diagrammatic representation of a top plan view of one embodiment of a ring antenna array element 300 with a mode suppression structure 301. Mode suppression structure 301 includes a conductive element 302 disposed between a first feed line 304 and a second feed line 306, all of which form a specifically tuned radio frequency circuit of ring antenna array element 300. First feed line 304 and second feed line 306 are capacitively coupled to a conductive resonator 308 and are configured to energize conductive resonator 308 such that it operates in a desired frequency band. Conductive resonator 308 is generically illustrated in FIG. 3 for contextual purposes. In various embodiments of ring antenna array element 300, conductive resonator 308 has a size and shape that is tunable to the desired frequency band. In certain embodiments, conductive resonator 308 is a conductive ring resonator, such as linked-ring resonator 102 (shown in FIG. 1) and cog ring conductive resonator 202 (shown in FIG. 2).

Conductive element 302 has a width 310 and a length 312 that are configured to tune conductive element 302 to be non-resonant in the desired frequency band of conductive resonator 308. Conductive element 302 is disposed such that it is substantially centered at a center 314 of conductive resonator 308.

Conductive element 302 is implemented on a layer of a circuit board beneath another layer on which conductive resonator 308 is implemented. First feed line 304 and second feed line 306 are implemented on the layer with conductive element 302 or above it. In certain embodiments, conductive element 302 is coupled to a grounding pin (not shown) that extends from a ground plane at least up to the layer of conductive element 302. In certain embodiments, the grounding pin extends up to the layer on which conductive resonator 308 is implemented.

When first feed line 304 and second feed line 306 are energized such that conductive resonator 308 operates in the desired frequency band, conductive element 302 is non-resonant in the band of operation, preventing or blocking energy from cross-coupling from first feed line 304 to second feed line 306 or vice versa.

Figure 4:
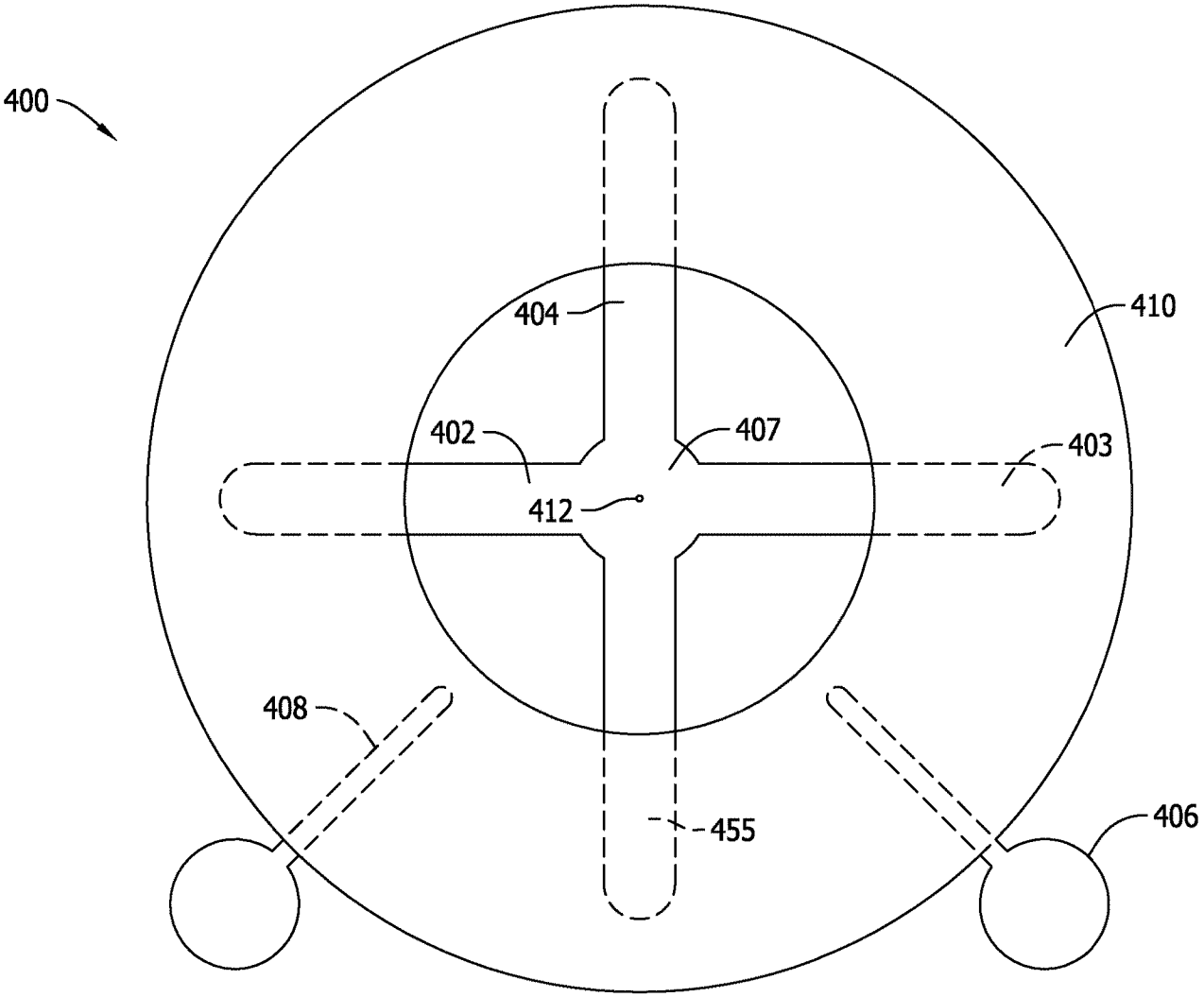
FIG. 4 is a diagrammatic representation of a top plan view of another embodiment of a ring antenna array element with a mode suppression structure.

FIG. 4 is a diagrammatic representation of a top plan view of another embodiment of a ring antenna array element 400 having a mode suppression structure 401. Mode suppression structure 401 includes four conductive elements that join at a circular conductive hub 407, including a first conductive element 402, a second conductive element 403, a third conductive element 404, and a fourth conductive element 405. Each of conductive elements 402-405 extend radially from circular conductive hub 407, substantially forming a single cross-shaped conductive element. First conductive element 402 crosses second conductive element 403 at a center 412, which coincides with the center of conductive resonator 410 and circular conductive hub 407. First conductive element 402 is separated by an angle of substantially 90 degrees from third conductive element 404, as is fourth conductive element 405. Second conductive element 403 is similarly disposed with respect to third conductive element 404 and fourth conductive element 405. In alternative embodiments, first conductive element 402 and third conductive element 404 may be separated by any other suitable angle for the frequencies mode suppression structure 401 is intended to suppress.

Mode suppression structure 401 is disposed between a first feed line 406 and a second feed line 408. More specifically, fourth conductive element 405 is disposed between first feed line 406 and second feed line 408. Together, mode suppression structure 401, first feed line 406, and second feed line 408 form a radio frequency circuit for ring antenna array element 400. First feed line 406 and second feed line 408 are capacitively coupled to a conductive resonator 410 and are configured to energize conductive resonator 410 such that it operates in a desired frequency band. Conductive resonator 410 is generically illustrated in FIG. 4 for contextual purposes. In various embodiments of mode suppression structure 400, conductive resonator 410 has a size and shape that is tunable to the desired frequency band.

Similar to conductive element 302, conductive elements 402-405 have widths and lengths configured to tune mode suppression structure 401 to resonate in a frequency band outside of the desired frequency band of conductive resonator 410. In alternative embodiments, the respective lengths and widths of conductive elements 402-405 are different from one another.

Conductive elements 402-405 are implemented on a layer of a circuit board beneath another layer on which conductive resonator 410 is implemented. First feed line 406 and second feed line 408 are implemented on the layer with conductive elements 402-405, or above it. In certain embodiments, conductive elements 402-405 are coupled to a grounding pin (not shown) that extends from a ground plane at least up to the layer of conductive elements 402-405. In certain embodiments, the grounding pin extends up to the layer on which conductive resonator 410 is implemented.

Conductive resonator 410 has a size and shape that is tunable to the desired frequency band. In certain embodiments, conductive resonator 410 is a conductive ring resonator, such as linked-ring resonator 102 (shown in FIG. 1) and cog ring conductive resonator 202 (shown in FIG. 2).

When first feed line 406 and second feed line 408 are energized such that conductive resonator 410 operates in the desired frequency band, conductive elements 402-405 resonate outside that band, preventing energy outside that band from cross-coupling from first feed line 406 to second feed line 408 or vice versa.

Figure 5:
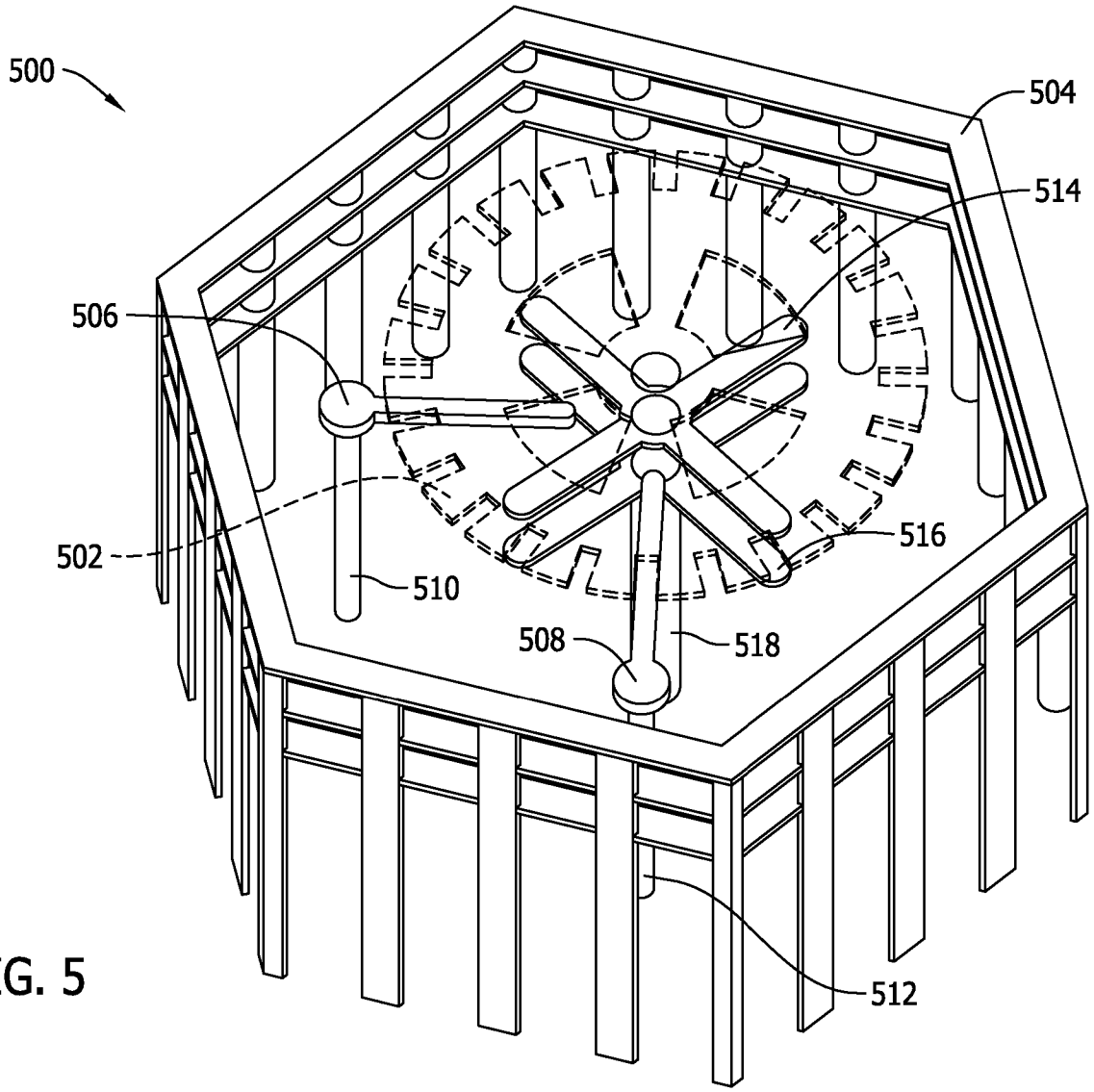
FIG. 5 is a diagram of one embodiment of a ring antenna array element with a mode suppression structure.

FIG. 5 is a diagram of one embodiment of a ring antenna array element 500. Ring antenna array element 500 includes a conductive resonator 502 surrounded by a Faraday cage 504. Conductive resonator 502 is implemented on a first layer of a circuit board. Faraday cage 504 extends from the first layer down through lower layers to a ground plane (not shown). Conductive resonator 502 is fed by a first feed line 506 and a second feed line 508. First feed line 506 and second feed line 508 are implemented on a second layer, beneath conductive resonator 502, and are capacitively coupled to conductive resonator 502.

Current is respectively delivered to first feed line 506 and second feed line 508 through a first signal via 510 and a second signal via 512. The current causes conductive resonator to be energized. When energized, conductive resonator 502 operates over a desired band of frequencies.

Ring antenna array element 500 also includes a first mode suppression structure 514 and a second mode suppression structure 516. First mode suppression structure 514 is implemented on the second layer with first feed line 506 and second feed line 508. Second mode suppression structure 516 is implemented on a third layer, below the first and second layers. In alternative embodiments, first mode suppression structure 514 and second mode suppression structure 516 may be implemented on layers below the layer containing first feed line 506 and second feed line 508. For example, and without limitation, first mode suppression structure 514 and second mode suppression structure 516 may be implemented on the third and a fourth layer. In certain embodiments, ring antenna array element 500 includes a shorting pin 518 that extends from conductive resonator 502 on the first layer to a ground plane on a lower layer.

First mode suppression structure 514 and second mode suppression structure 516 include tuned conductive crosses disposed between first feed line 506 and second feed line 508. Each of the tuned conductive crosses of first mode suppression structure 514 and second mode suppression structure 516 includes two conductive elements that cross at a center point, which coincides with a center point of conductive resonator 502. The two conductive elements in each cross are separated by an angle. In the embodiment of FIG. 5, the angle is substantially 90 degrees. In alternative embodiments, the angle may be more or less than 90 degrees, whichever is suitable for a given antenna and a desired frequency response of first mode suppression structure 514 and second mode suppression structure 516. Each conductive element in first mode suppression structure 514 and second mode suppression structure 516 has a length and width that are tunable for a particular frequency band to suppress. In alternative embodiments, the number of conductive elements and their respective locations vary according to the desired frequency response.

Practical limits exist for the tunable aspects of first mode suppression structure 514 and second mode suppression structure 516, which include, without limitation, length, width, shape, location, and angular separation. For example, long conductive elements that extend from the center point to Faraday cage 504 more completely isolate first feed line 506 and second feed line 508. However, consequently, first mode suppression structure 514 and second mode suppression structure 516 may encroach on the operable frequency band of conductive resonator 502 and, in turn, the operable frequency band of ring antenna array element 500, effectively suppressing a portion of the useable bandwidth. Similarly, certain embodiments may have conductive elements so numerous that they inhibit efficient operation of conductive resonator 502 and, in turn, the operation of ring antenna array element 500.

Figure 6:
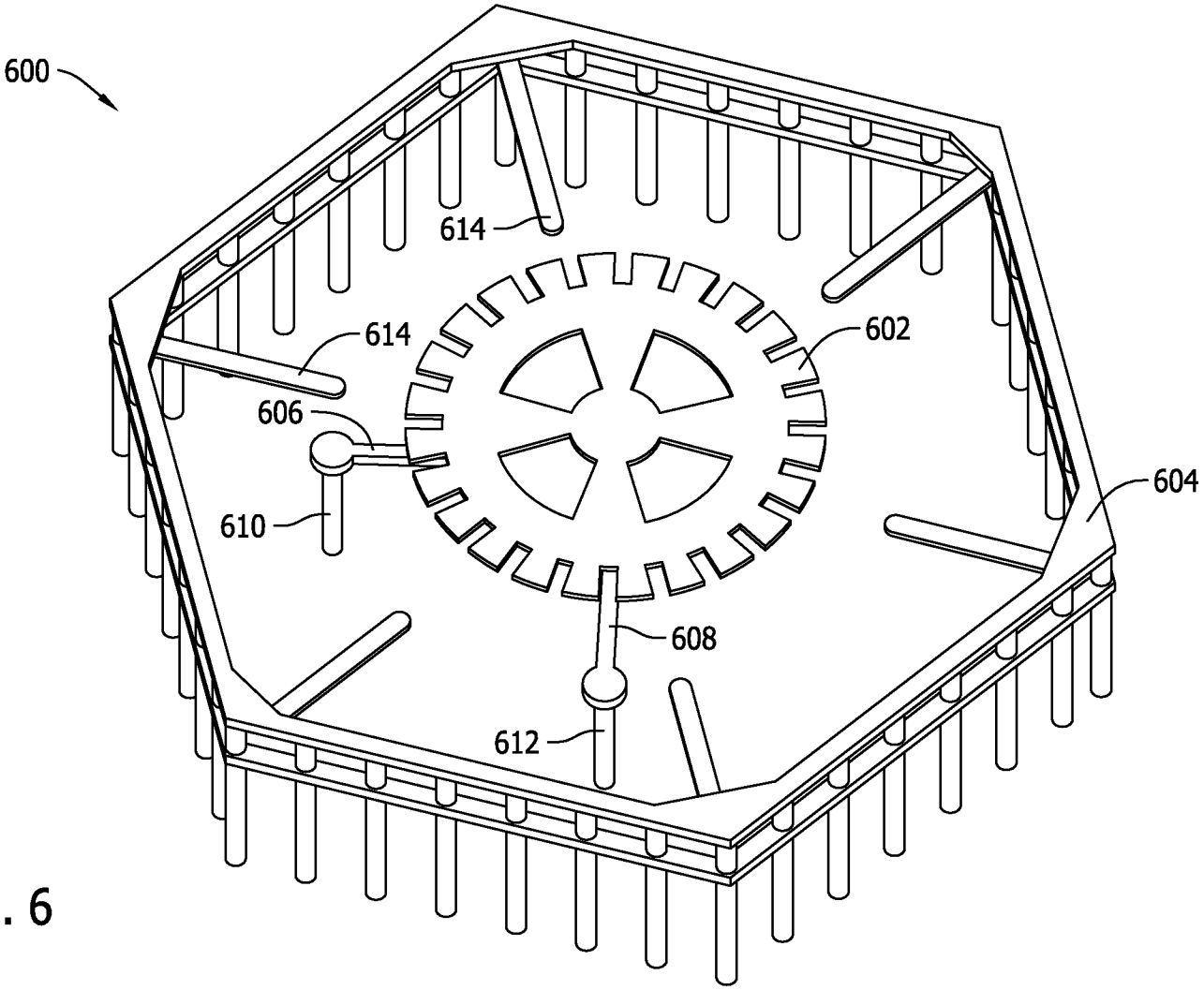
FIG. 6 is a diagram of another embodiment of a ring antenna array element with a mode suppression structure.

FIG. 6 is a diagram of another embodiment of a ring antenna array element 600. Ring antenna array element 600 includes a conductive resonator 602 surrounded by a Faraday cage 604. Conductive resonator 602 is implemented on a first layer of a circuit board. Faraday cage 604 extends from the first layer down through lower layers to a ground plane (not shown). Conductive resonator 602 is fed by a first feed line 606 and a second feed line 608. First feed line 606 and second feed line 608 are implemented on a second layer, beneath conductive resonator 602, and are capacitively coupled to conductive resonator 602.

Current is respectively delivered to first feed line 606 and second feed line 608 through a first signal via 610 and a second signal via 612. The current causes conductive resonator to be energized. When energized, conductive resonator 602 operates over a desired band of frequencies.

Ring antenna array element 600 also includes a mode suppression structure 614. Mode suppression structure 614 is implemented on the second layer with first feed line 606 and second feed line 608. In alternative embodiments, mode suppression structure 614 may be implemented on layers below the layer containing first feed line 606 and second feed line 608. For example, and without limitation, mode suppression structure 614 may be implemented on a third or a fourth layer.

Mode suppression structure 614 includes tuned conductive stubs extending from Faraday cage 604 toward a center point of conductive resonator 602. The conductive stubs are disposed between first feed line 606 and second feed line 608. Each conductive stub in mode suppression structure 614 has a length and width that are tunable for a particular frequency band to suppress. In alternative embodiments, the number of conductive elements and their respective locations vary according to the desired frequency response.

Practical limits exist for the tunable aspects of mode suppression structure 614, which include, without limitation, length, width, shape, location, and angular separation. For example, long conductive elements, or elements that extend from Faraday cage 504 further toward the center of conductive resonator 602, more completely isolate first feed line 606 and second feed line 608. However, consequently, mode suppression structure 614 may encroach on the operable frequency band of conductive resonator 602 and, in turn, the operable frequency band of ring antenna array element 600, effectively suppressing a portion of the useable bandwidth. Similarly, certain embodiments may have conductive elements so numerous that they inhibit efficient operation of conductive resonator 602 and, in turn, the operation of ring antenna array element 600.

Figure 7:
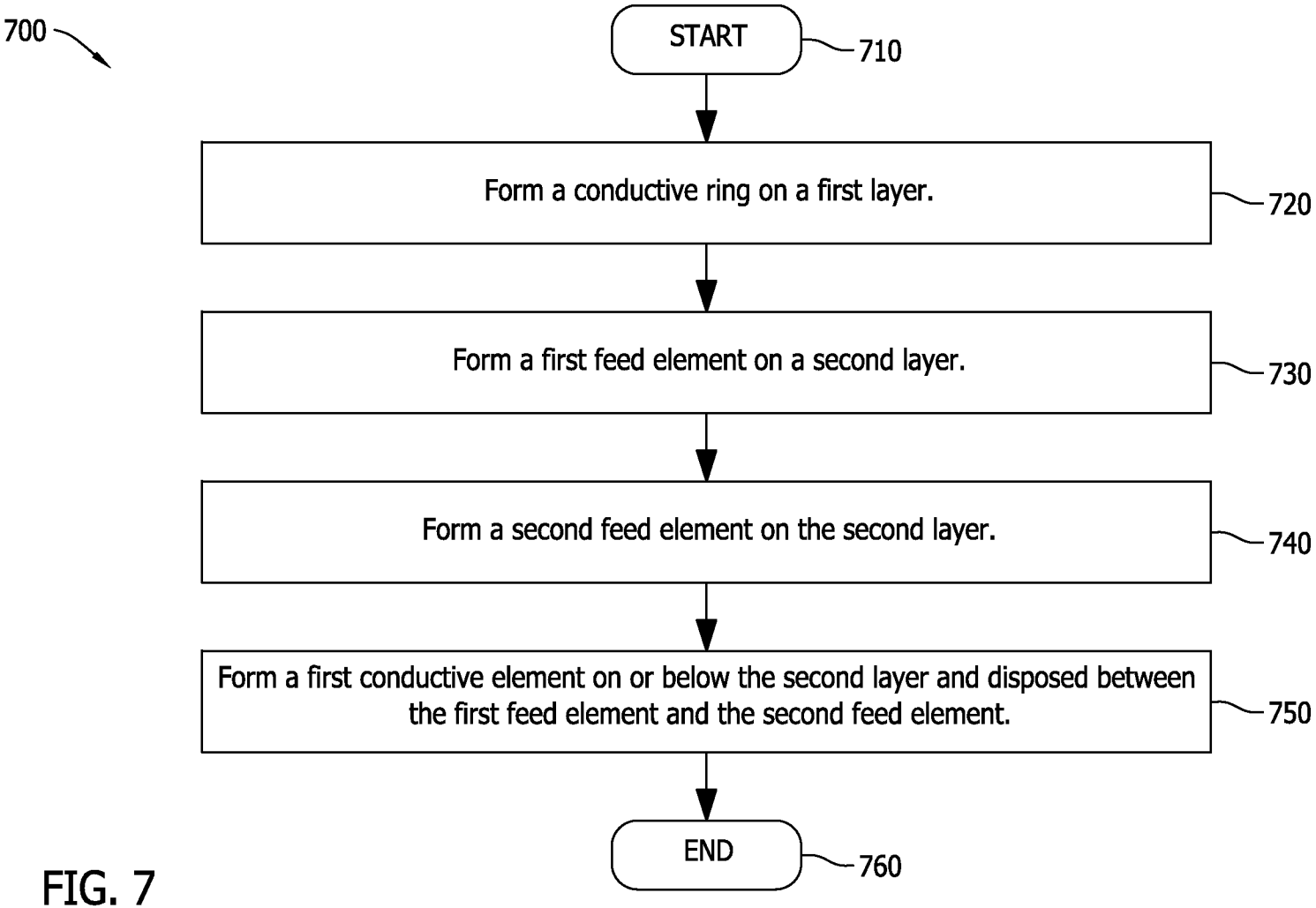
FIG. 7 is flow diagram of one embodiment of a method of forming an antenna array.

FIG. 7 is a flow diagram of one embodiment of a method 700 of forming an antenna array. The antenna array includes multiple antenna array elements, such as antenna 500 or antenna 600 (shown in FIGS. 5 and 6), disposed in a particular arrangement, or structure. In certain embodiments, for example, the antenna array elements are disposed in a lattice structure. The method begins at a start step 710. At a first forming step 720, a conductive ring is formed on a first layer of a circuit board. The conductive ring, when energized, is operable over a first and second frequency band. First forming step 720, in certain embodiments, includes forming cog structures around an inner or outer perimeter of the conductive ring, which provides improved bandwidth and tunability. In certain embodiments, first forming step 720 may include forming tuning slots within the conductive ring, further improving the tunability of the conductive ring to the first and second frequency bands.

At a second forming step 730, a first feed element is formed on a second layer of the circuit board. The first feed element is capacitively coupled to the conductive ring. At a third forming step 740, a second feed element is formed on the second layer of the circuit board. The second feed element is also capacitively coupled to the conductive ring. The second feed element is separated from the first feed element by an angle. The angle, in certain embodiments, is substantially 90 degrees. A substantially 90 degree angle should measure 90 degrees, plus or minus 5 degrees. In alternative embodiments, the angle could be substantially 60 degrees, while in other embodiments the angle could be substantially 120 degrees, or any other suitable angle.

The first and second feed elements formed at second forming step 730 and third forming step 740 carry current that couples into the conductive ring. The conductive ring resonates at frequencies spanning the first and second frequency bands.

At a fourth forming step 750, a conductive element is formed on or below the second layer of the circuit board. The conductive element is disposed between the first and second feed element. The conductive element has a length and width that are configured to tune the conductive element to be non-resonant inside the first and second frequency bands, such that the conductive element may resonate outside of the in-band frequencies. The conductive element, during operation of the antenna, reduces or blocks cross-coupling between the first and second feed lines. The length of the conductive element controls mainly the frequency at which it will resonate and the width is used to both set the impedance of the feature and the amount of in-band reduction in cross-coupling. The method ends at an end step 760.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radio frequency (RF) circuit for a ring antenna array element, comprising:

a first feed element capacitively couplable to a conductive resonator for a frequency band, the conductive resonator defining a first plane, the first feed element extending radially with respect to the ring antenna array element and disposed in a second plane parallel to the first plane, and configured to conduct a first electromagnetic current;

a second feed element capacitively couplable to the conductive resonator, extending radially with respect to the ring antenna array element, and disposed in the second plane parallel to the first plane; and a conductive element disposed between the first feed element and the second feed element, and further disposed in a third plane parallel to the first plane, the conductive element comprising a rectangular microstrip having at least a length and a width that define a resonant frequency thereof, wherein the resonant frequency exists outside the frequency band of the conductive resonator, and wherein the rectangular microstrip is capacitively couplable to the conductive resonator, and capacitively couplable to the first feed element and the second feed element to reduce cross-coupling between the first feed element and the second feed element due to the first electromagnetic current.

2. The RF circuit of claim 1, wherein the conductive element comprises a first tuned stub disposed between the first feed element and the second feed element, and a second tuned stub separated from the first tuned stub by substantially 90 degrees, wherein a center point of the first tuned stub intersects with a center point of the second tuned stub.

3. The RF circuit of claim 1, wherein the conductive element and at least one of the first feed element and the second feed element are disposed on a single layer of a circuit board, and wherein the second plane and the third plane are co-planar.

4. The RF circuit of claim 1, wherein the conductive element is further disposed substantially at a center of the conductive resonator.

5. The RF circuit of claim 1 further comprising a ground pin coupled to the conductive element and a ground plane.

6. The RF circuit of claim 1, wherein the first feed element has a first polarization and the second feed element has a second polarization offset from the first polarization by substantially 90 degrees.

7. An antenna array element, comprising:

a conductive resonator operable in at least a first frequency band and comprising a conductive ring defining a first plane;

a first feed element capacitively couplable to the conductive ring and configured to operate the conductive resonator in the first frequency band, the first feed element extending radially with respect to the conductive ring and disposed in a second plane parallel to the first plane;

a second feed element capacitively couplable to the conductive resonator, extending radially with respect to the conductive ring, and disposed in the second plane parallel to the first plane; and a mode suppression structure comprising a conductive element disposed between the first feed element and the second feed element, and further disposed in a third plane parallel to the first plane, the conductive element having at least a length, a width, and a shape that define a resonant frequency thereof, wherein the resonant frequency exists outside the first frequency band, and wherein the conductive element is capacitively couplable to the conductive resonator, and capacitively couplable to the first feed element and the second feed element to reduce cross-coupling between the first feed element and the second feed element.

8. The antenna array element of claim 7, wherein the conductive ring is disposed on an upper layer of a circuit board relative to the mode suppression structure, and the conductive element of the mode suppression structure is disposed on a lower layer of the circuit board relative to the upper layer, wherein the upper layer and the lower layer are separated by at least one dielectric layer.

9. The antenna array element of claim 7, wherein the mode suppression structure is substantially centered relative to the conductive resonator.

10. The antenna array element of claim 7, wherein the conductive element of the mode suppression structure further comprises a first tuned stub disposed between the first feed element and the second feed element, and a second tuned stub offset from the first tuned stub by an angle, wherein a center point of the first tuned stub intersects with a center point of the second tuned stub.

11. The antenna array element of claim 10, wherein the angle separating the first tuned stub and the second tuned stub is substantially 90 degrees.

12. The antenna array element of claim 7 further comprising a via extending from the conductive ring at least to the conductive element of the mode suppression structure.

13. The antenna array element of claim 12, wherein the via extends to a ground plane.

14. The antenna array element of claim 7 further comprising a second mode suppression structure disposed on a layer beneath the conductive element of the mode suppression structure and further disposed in a fourth plane parallel to the first plane.

15. The antenna array element of claim 7, wherein the second feed element is configured to operate the conductive resonator in a second frequency band, and wherein the resonant frequency of the conductive element of the mode suppression structure is outside the second frequency band.

16. A method of forming an antenna array on a circuit board, the method comprising:

forming a conductive ring on a first layer, the conductive ring operable in a first frequency band and a second frequency band;

forming a first feed element on a second layer, the first feed element capacitively coupled to the conductive ring and extending radially with respect to the conductive ring;

forming a second feed element on the second layer, the second feed element separated from the first feed element by an angle, extending radially with respect to the conductive ring, and capacitively coupled to the conductive ring; and forming a first conductive element on or below the second layer and disposed between the first feed element and the second feed element, the first conductive element having at least a shape, a length, and a width that define a resonant frequency thereof, wherein the resonant frequency exists outside the first frequency band and the second frequency band.

17. The method of claim 16 further comprising forming a Faraday cage around the conductive ring and extending through at least the first layer, the second layer, and to a ground plane.

18. The method of claim 16 further comprising forming a second conductive element on the second layer, the second conductive element disposed normally to the first conductive element, wherein the first conductive element and the second conductive element are substantially centered on the conductive ring, thereby forming a first tuned cross.

19. The method of claim 18 further comprising forming a second tuned cross on a third layer below the first tuned cross.

20. The method of claim 16 further comprising repeating the forming of the conductive ring, the forming of the first feed element, the forming of the second feed element, and the forming of the first conductive element to construct an array of antenna array elements disposed in a lattice structure.

* * * * *